US008496459B2

(12) United States Patent
Schütt

(10) Patent No.: US 8,496,459 B2
(45) Date of Patent: Jul. 30, 2013

(54) APPARATUS FOR PRODUCING A SPUNBONDED FABRIC

(75) Inventor: Günter Schütt, Neumünster (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 52 days.

(21) Appl. No.: 13/105,197

(22) Filed: May 11, 2011

(65) Prior Publication Data

US 2011/0244066 A1 Oct. 6, 2011

Related U.S. Application Data

(63) Continuation of application No. PCT/EP2009/064414, filed on Nov. 2, 2009.

(30) Foreign Application Priority Data

Nov. 13, 2008 (DE) ..... 10 2008 057 172

(51) Int. Cl.
*D04H 1/732* (2012.01)

(52) U.S. Cl.
USPC ..... 425/83.1; 425/66; 425/72.2

(58) Field of Classification Search
USPC ..... 425/66, 72.2, 83.1
See application file for complete search history.

(56) References Cited

U.S. PATENT DOCUMENTS

| | | | | |
|---|---|---|---|---|
| 2,925,117 | A * | 2/1960 | Moore et al. | 425/83.1 |
| 3,441,468 | A * | 4/1969 | Siggel et al. | 425/72.2 |
| 3,707,593 | A * | 12/1972 | Fukada et al. | 264/555 |
| 3,806,289 | A * | 4/1974 | Schwarz | 425/72.2 |
| 3,978,185 | A * | 8/1976 | Buntin et al. | 264/518 |
| 4,656,081 | A | 4/1987 | Ando et al. | |
| 6,315,806 | B1 | 11/2001 | Torobin et al. | |
| 6,402,492 | B1 * | 6/2002 | Achterwinter et al. | 425/72.2 |

FOREIGN PATENT DOCUMENTS

| | | | |
|---|---|---|---|
| EP | 0825287 | A1 | 2/1998 |
| EP | 1234906 | A1 | 8/2002 |
| WO | 2006/032517 | A1 | 3/2006 |

* cited by examiner

*Primary Examiner* — Yogendra Gupta
*Assistant Examiner* — Joseph Leyson
(74) *Attorney, Agent, or Firm* — BainwoodHuang

(57) ABSTRACT

An apparatus is configured to produce a spunbonded fabric. In order to achieve an airiness of the spunbonded fabric and ready adaptability to process parameters which are to be changed, a spinning beam together with a blowing apparatus is configured to be pivotable in a pivoting unit. A relatively high airiness is achieved by the filaments running obliquely onto the fabric belt below the spinning beam. Rotary leadthroughs or elastic feed lines to the spinning beam make the slight pivoting possible.

8 Claims, 4 Drawing Sheets

APPARATUS FOR PRODUCING A SPUNBONDED FABRIC

CROSS REFERENCE TO RELATED APPLICATIONS

This patent application is a Continuation of PCT Patent Application No. PCT/EP2009/064414 filed on Nov. 2, 2009, entitled "APPARATUS FOR PRODUCING A SPUNBONDED FABRIC", which claims priority to German Patent Application No. 10 2008 057 172.5 filed on Nov. 13, 2008, the contents and teachings of each of which are hereby incorporated by reference in their entirety.

BACKGROUND

The invention relates to an apparatus for producing a spunbonded fabric.

In the production of non-woven fabrics a plurality of filaments are extruded from a polymer melt and formed into an area construct on an airy fabric belt, while the fabric belt transports the fabric away. An apparatus of this class is described in patent specification DE 199 13 162 C1.

In this process, molten polymer supplied by an extruder is spun in a spinning beam via nozzle bores that are disposed in lines, specifically in single rows or multiple rows, first into a multitude of strands and, immediately after exiting the nozzles bores, shredded into fine filaments of finite length by an air flow that is supplied through a nozzle.

The filaments exit the air nozzle at a high speed and make contact with a fabric belt that is disposed at a certain distance where the filaments arrange themselves into an area construct. In the area between air nozzle and fabric belt the filaments undergo cooling. The conveying direction of the filaments between spinning beam, air nozzle and fabric belt is vertical. By a continuous movement of the fabric belt, which is configured as a conveyor belt, the non-woven fabric that is being formed is transported away, and wherein the alignment and conveying direction of the fabric belt are horizontal. A suction device is provided below the fabric belt that supports the formation of the non-woven fabric and ensures, in particular, that the air flow accompanying the filaments is transported away.

SUMMARY

When the filaments make contact with the fabric belt at a perpendicular angle and high speeds, most of the time the result is a non-woven fabric of high density. Many process parameters are prescribed by the setup of the apparatus, thus allowing for product variations only within a narrowly limited range.

But non-woven fabrics of high airiness are often required. To meet this requirement while ensuring a high level of flexibility with regard to the properties of the non-woven fabric, DE 199 13 162 C1 provides a fabric belt that is adjustable in terms of its height and incline. But this solution calls for a high level of construction complexity and suffers from the further disadvantage that the component groups downstream of the fabric belt must also be adjusted.

Further solutions for achieving an increase in flexibility are known from DE 42 383 47 C2 which provides adjustable blower lips for adapting the apparatus to the process parameters. Various publications also teach disposing passive air-conducting mechanisms or of an active blowing apparatus disposed between the filament exit and the fabric belt that influence the placement of the filaments on the fabric belt.

The solutions that were referred to last are suitable for influencing the filament placement within narrow limitations, but their suitability for producing non-woven fabrics of high airiness is quite restrictive.

It is therefore the object of the present invention to provide an apparatus that allows for wide variations of the process parameters during the production of a spunbonded fabric and that allows, moreover, for producing a spunbonded fabric that is especially airy.

The object is achieved with an apparatus for producing a spunbonded fabric. The apparatus includes a spinning beam for extruding melt strands, a blowing apparatus disposed behind their exit, and a fabric belt apparatus disposed vertically below the spinning beam having a fabric belt that is movable in the conveying direction. The spinning beam and the blowing apparatus being adjustable around a horizontal swivel axis having an essentially perpendicular alignment relative to the conveying direction The easy adaptability to different process parameters and thereby to different products is achieved by the ability of the spinning beam to pivot together with the blowing apparatus around a horizontal axis. The axis is in a vertical alignment relative to the conveying direction of the fabric belt, whereby any pivoting around the axis will change the point of impact of the filaments on the fabric belt in the conveying direction. It was found that the essential effect that causes the higher airiness of the non-woven fabric is due to the angle at which the filaments make contact with the fabric belt and/or on the non-woven fabric that has already been partially formed previously. With an impact at an oblique angle it is possible, in particular, to reduce the dynamic pressure that forms and acts upon the filaments. By adjusting the angle it is possible to arrive at a fine adjustment of the airiness. Furthermore, the angle has an influence on the three-dimensionally forming random arrangements of the filament inside the non-woven fabric.

A preferred embodied example provides that the spinning beam is disposed together with the blowing apparatus inside a pivoting unit that can be pivoted around a swivel axis.

Preferably, the pivoting range is between +45° and −45° relative to the perpendicular line, because any great effect relative to the airiness of the non-woven fabric is to be expected in this range.

A further preferred embodied variant provides that the suction, which is provided below the fabric belt, is adjustable in the pivoting direction, and thereby in the conveying direction. On the one hand, this way it is possible to adjust the center of gravity of the vacuum profile that is located below the fabric belt to the point of impact of the filaments. On the other hand, targeted shifting of this vacuum profile allows for further influencing of the process parameters.

The swivel axis is advantageously identical with or at least close to the neutral axis of the pivoting unit and/or the spinning beam and blowing apparatus. This way, only minimal adjustment forces are necessary.

A further especially preferred embodied variant provides a carriage for changing the distance between the spinning beam and the fabric beam. On the one hand, this is useful to compensate in a swiveled pivoting unit the higher distance of throw of the filaments. On the other hand, this provides for another changeable process parameter.

In another, also advantageous, embodied example the spinning beam and the blowing apparatus are connected by flexible supply lines with the melt feed and the compressed air feed. In this context, a flexible supply line is, for example, a flexural-elastic tube and/or hose connection, but also a stationary pipe connection with rotary leadthroughs. This allows for an easy adjustment during operation so that the effects of any change of the process parameters can be easily checked on the product. The type and configuration of the flexible supply lines can be determined by the person skilled in the art.

The combination of spinning beam and blowing apparatus according to the invention can be envisioned in one embodied variant in such a way that the filaments are produced according to the meltblown process.

In another embodied variant according to the invention the blowing apparatus is configured in such a way that it serves as a haul-off nozzle for the filaments that are extruded by the spinning beam.

BRIEF DESCRIPTION OF THE DRAWINGS

One embodied example will subsequently be described in further detail in accordance with the enclosed drawings. Shown are in.

DETAILED DESCRIPTION

Figure 1:
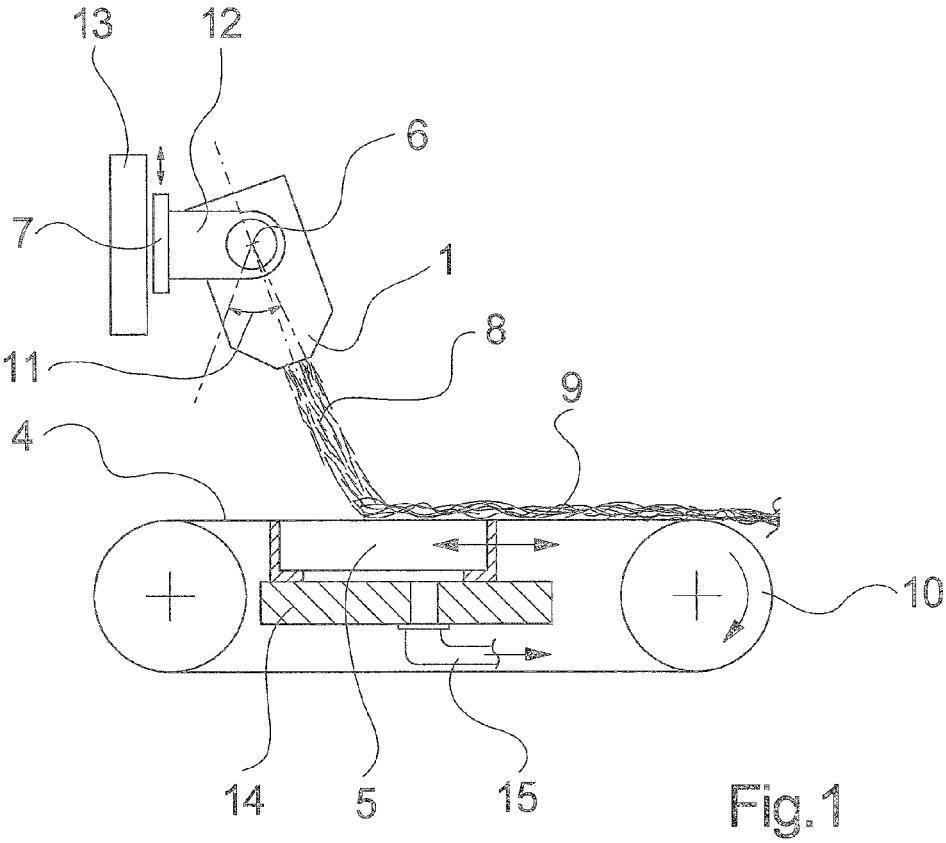
FIG. 1: A side view of the apparatus according to the invention.

FIG. 1 shows a side view of the apparatus according to the invention for the production of a spunbonded fabric.

A spinning beam, not shown here, and a blowing apparatus are integrated in a pivoting unit 1 in such a way that a filament curtain 8 is conveyed from the bottom side of the pivoting unit 1. The filaments 8 make contact with the fabric belt 4 that is operated by drive 10. An area construct results due to the high speed at which the filaments 8 make contact with the fabric belt 4, which is transported away as spunbonded fabric 9 by the fabric belt 4 and fed to further processing facilities that are not shown here. A suction box 5 is provided below the point at which the filaments 8 contact the fabric belt 4, which is displaceable in the conveying direction of the fabric belt 4. To this end, the suction box 5 is positioned on a carrier 14 that is connected with the suction apparatus 15. This way it is possible to adjust the vacuum range that is applied to the fabric belt 4 by way of suction box 5. In addition, by shifting to the front or rear of the point of contact it is possible to influence the formation of the spunbonded fabric 9.

In order to easily adjust the apparatus according to the invention to the process parameters, the pivoting unit 1 is supported with the ability to pivot on the swivel axis 6. A swivel axis 6 that is in or in the proximity of the neutral axis of the pivoting unit 1 is preferred. Additional adjustments of the process parameters are possible in that the pivoting unit 1 is connected to a carriage 7 by a holder 12, which is movable on a track 13 in a vertical direction.

Figure 2:
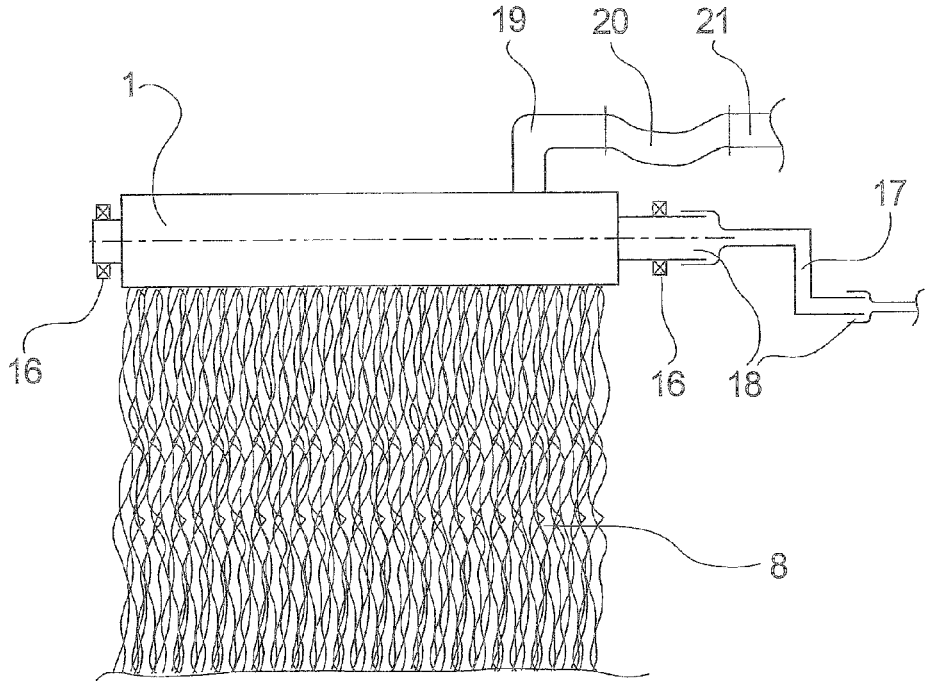
FIG. 2: A front view of the apparatus according to the invention.

FIG. 2 shows a front view of the apparatus as depicted in FIG. 1. The pivoting unit 1 extends over the width of the spunbonded fabric 9 that is to be produced. At the bottom side the filaments 8 that were generated inside the pivoting unit leave said pivoting unit 1 by way of a curtain. The pivoting unit 1 is pivotably supported inside bearings 16. For reasons of simplification the adjustment in vertical direction is not shown. The melt that is necessary for the production of the filaments 8 is supplied to the apparatus by the melt feed line 17 through a rotary leadthrough 18.1. This allows for the pivoting action of the pivoting unit during operation. During this process, it is not the continuous pivoting motion of the pivoting unit 1 that is the focus, but rather the adjustment to a required product when the production process is started. The rotary leadthrough 18.1 that is depicted here allows for pivoting action of the pivoting unit around a swivel axis. The melt feed line 17 has a further rotary leadthrough 18.2 in order to allow for the vertical adjustment as provided in an improvement according to the invention and as represented in FIG. 1 as well. The blowing air for the blowing apparatus is supplied by a blowing air feed 21, an elastic connection 20 and the blowing air line 19. In the alternative to the rotary leadthroughs 18.1 and 18.2, an elastic connection 20, in this instance, allows for a degree of freedom of the pivoting unit 1. Other possibilities of supplying the melt and the blowing air to the pivoting unit 1 that deviate from the above and are alternative relative to the depicted embodiments are also known in the art and fall within the scope of the present invention. For example, it is possible to supply the blowing air on the side that is opposite to the side of the melt feed also by way of rotary leadthroughs.

Figure 3:
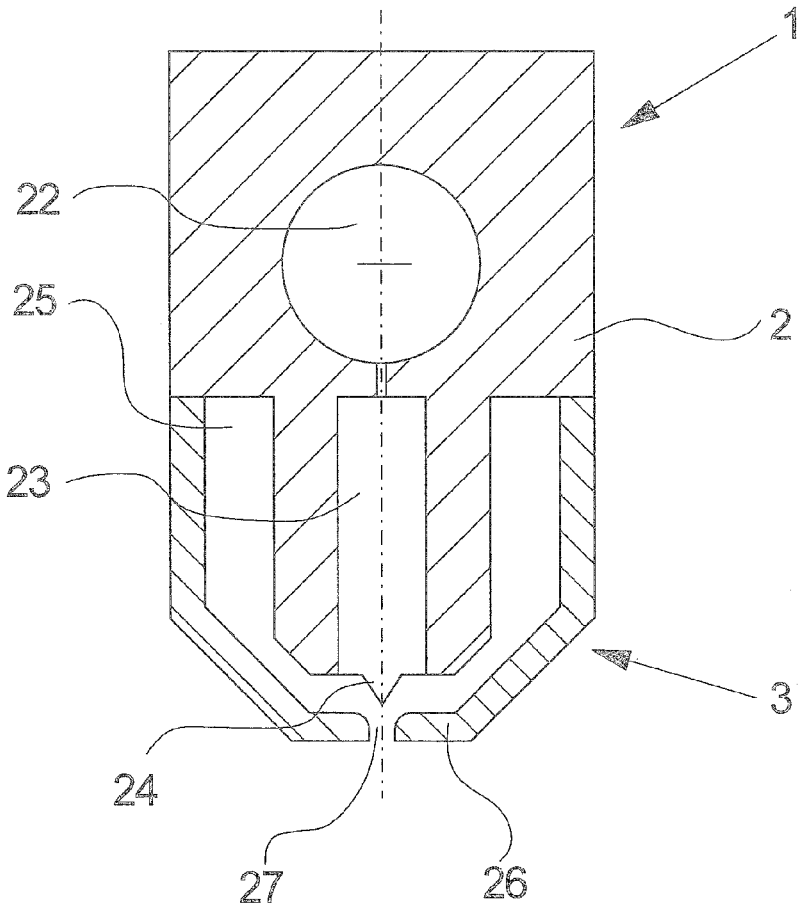
FIG. 3: A sectional view of an embodied variant of a spinning beam and blowing apparatus.

FIG. 3 shows a sectional view of the pivoting unit 1. The pivoting unit 1 includes a spinning beam 2 as well as the blowing apparatus 3. Within the spinning beam 2, the melt is distributed over a melt channel 22 and supplied to a nozzle 24 by way of a melt feed 23. Below and laterally of the nozzle, the blowing apparatus 3 directs the blowing air via the blowing air nozzle 26, which is produced by the application of pressure via the blowing air chamber 25, at a high speed onto the exiting melt strands, whereby the melt is shredded into fine filaments. This process is known as the meltblown method. The filaments leave the pivoting unit 1 at high speeds via the exit 27, as shown in FIGS. 1 and 2.

Figure 4:
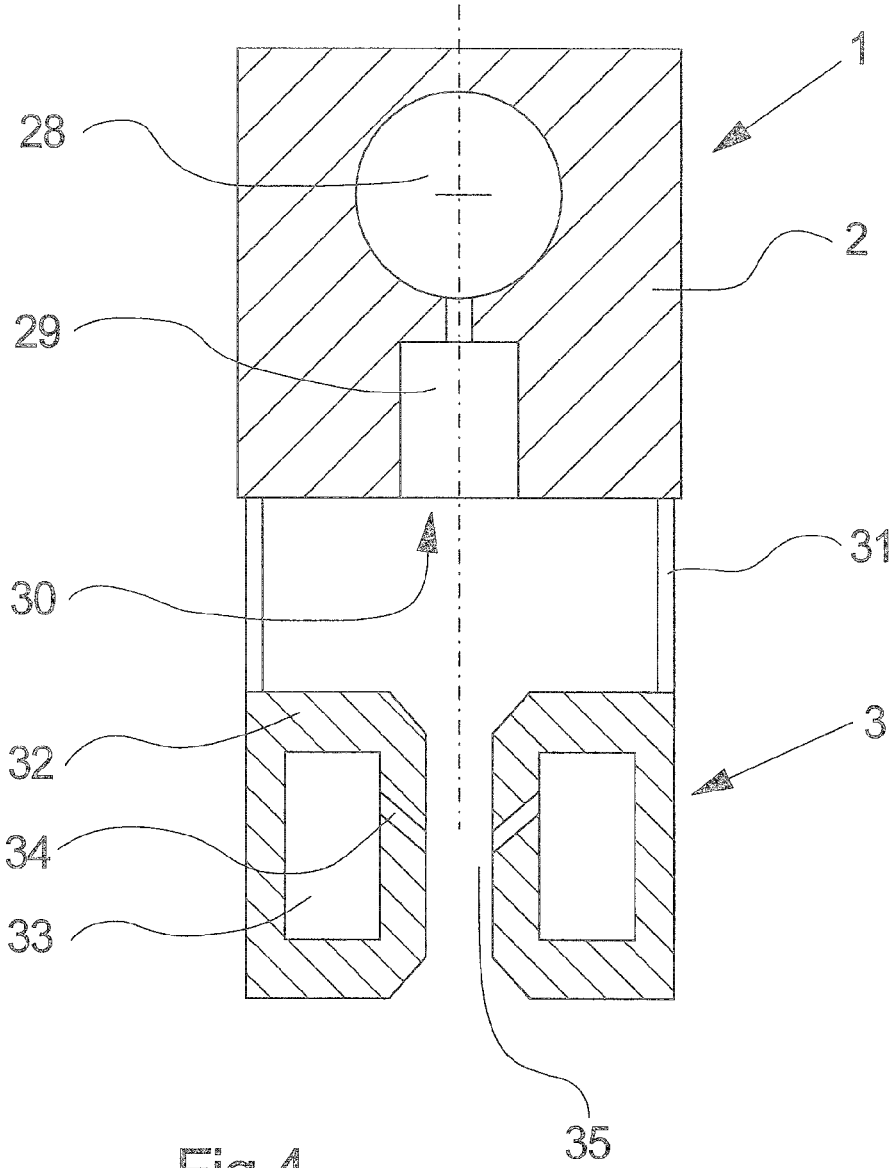
FIG. 4: A sectional view of a further embodied variant of a spinning beam and a blowing apparatus.

In an alternative to the variant in FIG. 3, FIG. 4 shows an alternative embodied example of a pivoting unit 1 in which the filaments are formed directly from the spinning beam 2. To this end, in this instance as well, the melt is distributed by a melt channel 28 inside the spinning beam and extruded by the melt feeds 29 into filaments. The blowing apparatus 3 is disposed at a distance below the spinning beam 2. This is achieved by the air-permeable connections 31. The blowing apparatus 3 is configured in such a way that a channel is formed between the two halves into which flows the compressed air via the air nozzles 34, which was pressurized in a blowing air chamber 33, at a high speed and in the conveying direction. This way, a pull is applied to the filaments transporting them out of the pivoting unit 1.

LIST OF THE REFERENCE SIGNS

1 Pivoting unit
2 Spinning beam
3 Blowing unit
4 Fabric belt
5 Suction box
6 Swivel axis
7 Carriage
8 Filament curtain
9 Spunbonded fabric
10 Drive
11 Pivoting range
12 Holder
13 Track
14 Carrier
15 Suction apparatus
16 Bearing
17 Melt feed line
18.1, 18.2 Rotary leadthrough

19 Blowing air line
20 Elastic connection
21 Blowing air feed
22 Melt channel
23 Melt feed line
24 Nozzle
25 Blowing air chamber
26 Blowing air nozzle
27 Exit
28 Melt channel
29 Melt feed
30 Nozzles
31 Connection
32 Haul-off nozzle
33 Blowing air chamber
34 Air nozzle
35 Channel

What is claimed is:

1. Apparatus for producing a spunbonded fabric comprising:

a spinning beam for extruding melt strands;

a blowing apparatus disposed behind their exit, and a fabric belt apparatus disposed vertically below the spinning beam having a fabric belt that is movable in the conveying direction;

the spinning beam and the blowing apparatus being adjustable around a horizontal swivel axis during operation and having an essentially perpendicular alignment relative to the conveying direction, wherein a suction box is disposed below the fabric belt, and wherein the suction box is displaceable in the pivoting direction.

2. Apparatus for producing a spunbonded fabric as claimed in claim 1, the spinning beam and the blowing apparatus are disposed in a pivoting unit that is pivotable around the swivel axis.

3. Apparatus for producing a spunbonded fabric as claimed in claim 1, wherein the pivoting range is between +45° and −45° relative to the vertical line.

4. Apparatus for producing a spunbonded fabric as claimed in claim 1, wherein the swivel axis corresponds essentially to the neutral axis of the pivoting unit that is to be pivoted.

5. Apparatus for producing a spunbonded fabric as claimed in claim 1, comprising a carriage configured to change the distance between the spinning beam and the fabric belt.

6. Apparatus for producing a spunbonded fabric as claimed in claim 1, wherein the spinning beam and the blowing apparatus are connected by flexible supply lines with the melt feed line and the blowing air feed.

7. Apparatus for producing a spunbonded fabric as claimed in claim 1 wherein the blowing apparatus is disposed immediately behind the exit of the melt from the spinning beam such that the blowing air is directed onto the melt strands at a high speed thereby shredding the melt.

8. Apparatus for producing a spunbonded fabric as claimed in claim 1, wherein the blowing apparatus is disposed after the exit of the melt from the spinning beam at such a distance that the blowing air is directed onto the filaments in such a way that said filaments are already partially cooled, and whereby the blowing air effects a pull that acts upon the filaments.

* * * * *